United States Patent [19]

Main et al.

[11] Patent Number: 4,895,270

[45] Date of Patent: Jan. 23, 1990

[54] SANITARY COVER FOR POP-TOP BEVERAGE CONTAINER

[76] Inventors: Daniel M. Main, 8605 Queen Elizabeth Blvd., Annandale, Va. 22003; James S. Ficklin, 5720 Dawes Ave., Alexandria, Va. 22311

[21] Appl. No.: 306,465

[22] Filed: Feb. 6, 1989

[51] Int. Cl.[4] ..... B65D 41/62

[52] U.S. Cl. ..... 220/257; 220/269; 220/270

[58] Field of Search ..... 220/257, 269, 270; 215/251, 254, 256

[56] References Cited

U.S. PATENT DOCUMENTS

| | | | |
|---|---|---|---|
| 1,675,170 | 6/1928 | Ehmann . | |
| 1,779,132 | 10/1930 | Kelling . | |
| 3,204,805 | 9/1965 | May | 220/257 |
| 3,272,367 | 9/1966 | Long | 215/251 |
| 3,862,614 | 1/1975 | Kovac | 215/317 |
| 3,976,216 | 8/1976 | Lambert | 215/307 |
| 4,142,940 | 3/1979 | Modollel et al. | 195/139 |
| 4,485,933 | 12/1984 | Sykes | 215/250 |
| 4,708,257 | 11/1987 | Deline | 220/257 |

*Primary Examiner*—Donald F. Norton

*Attorney, Agent, or Firm*—Kerkam, Stowell, Kondracki & Clarke

[57] ABSTRACT

A sanitary cover for a pop-top beverage container and the like comprises an elastic membrane formed to extend over the top and axially along a portion of the sidewall of the container. The membrane has a line of weakness and a pull tab attached thereto so as to enable the membrane to be ruptured along the line of weakness. Upon being ruptured, the membrane recedes from the top and gathers about the sidewall a predetermined distance from the top at which the membrane is attached to the sidewall to expose a clean mouth area for drainking at the top and sidewall of the container.

20 Claims, 3 Drawing Sheets

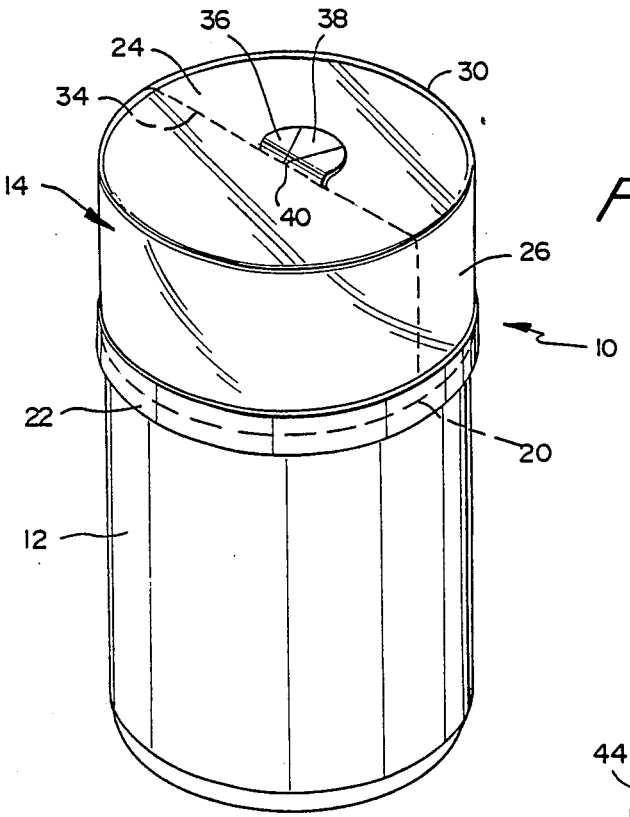
FIG. 1
FIG. 2
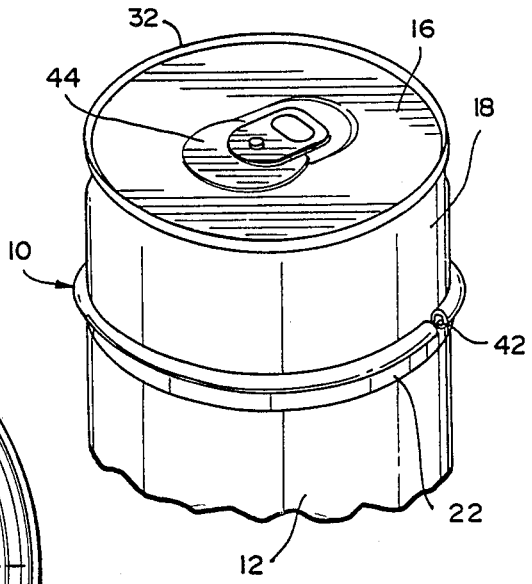
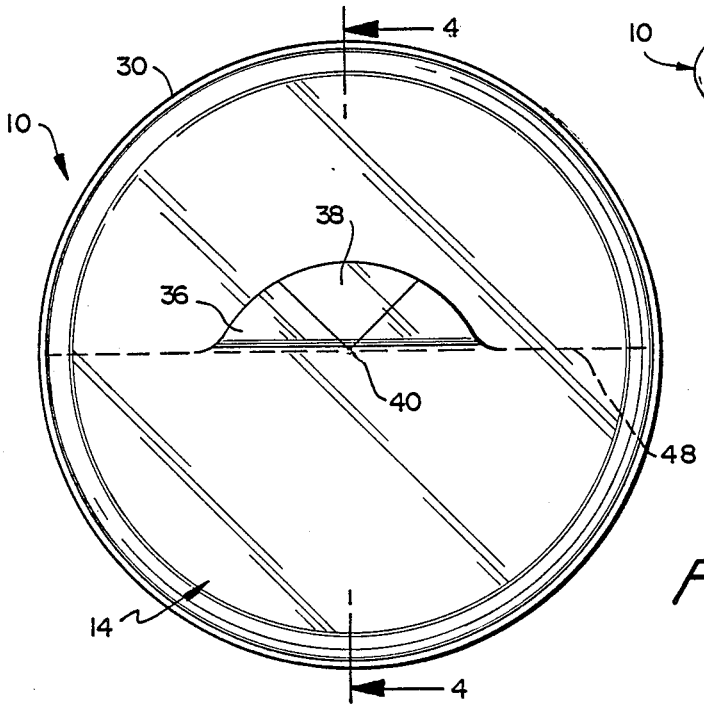
FIG. 3

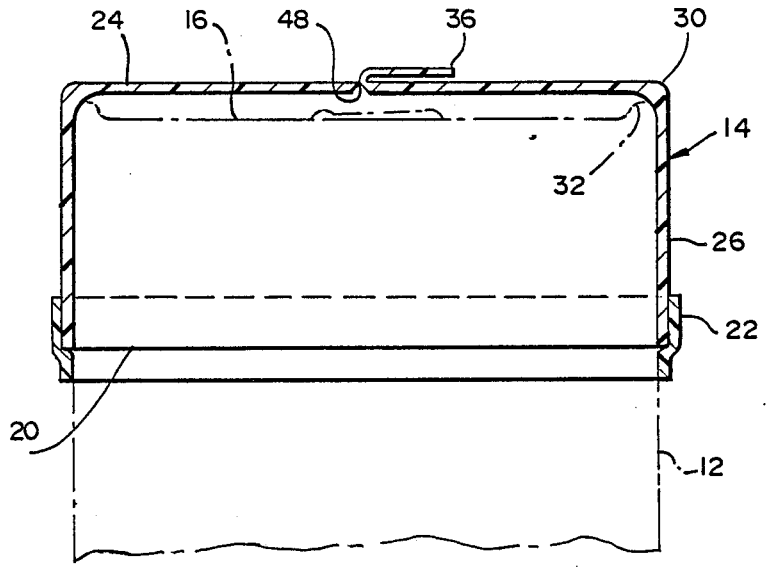
FIG. 4
FIG. 5
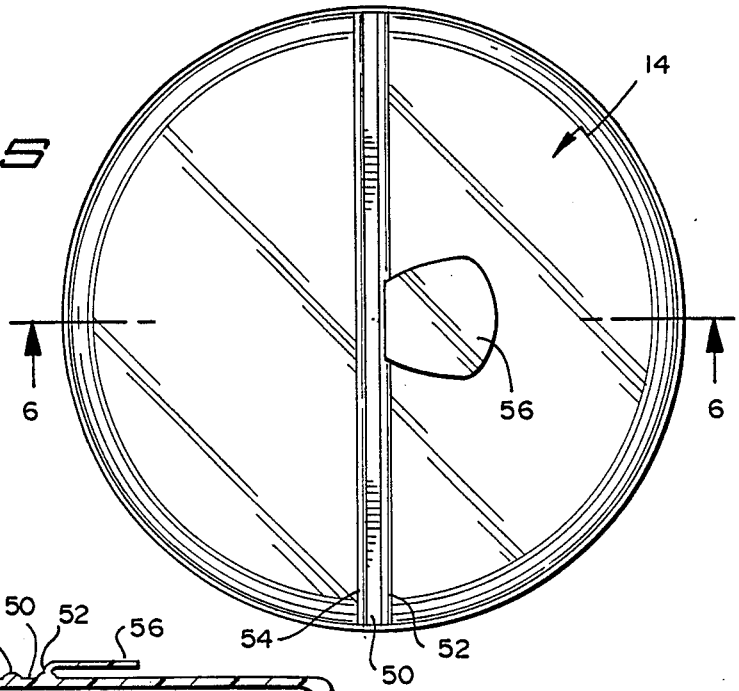
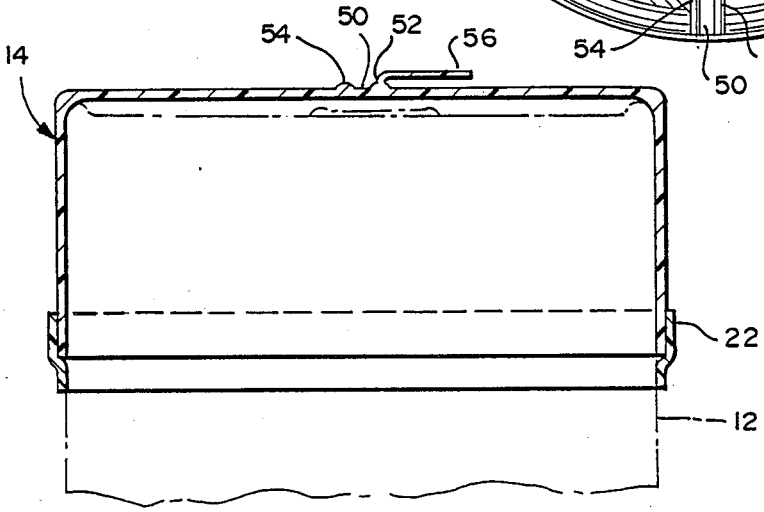
FIG. 6

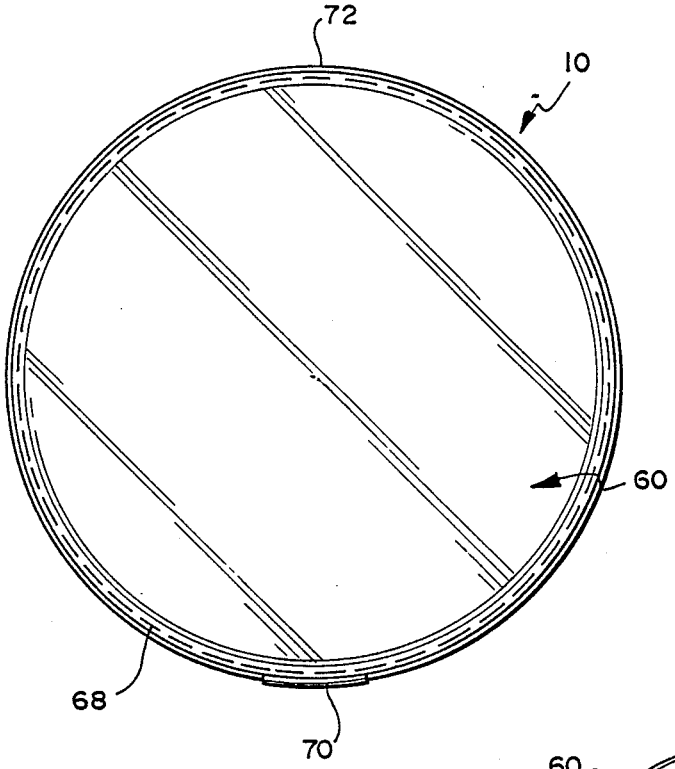
FIG. 7
FIG. 8
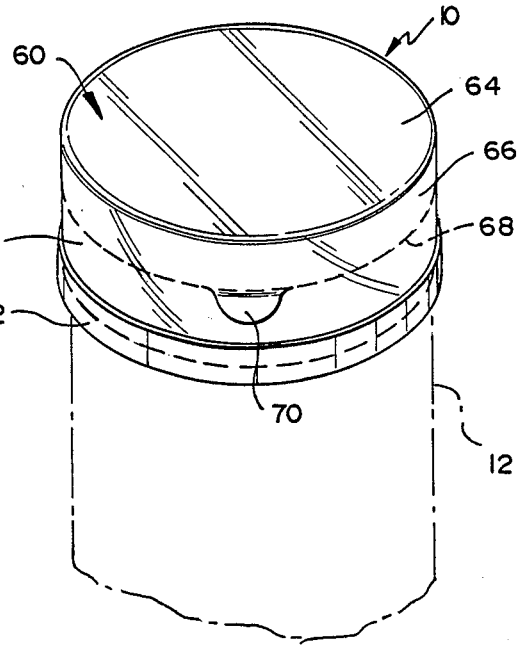
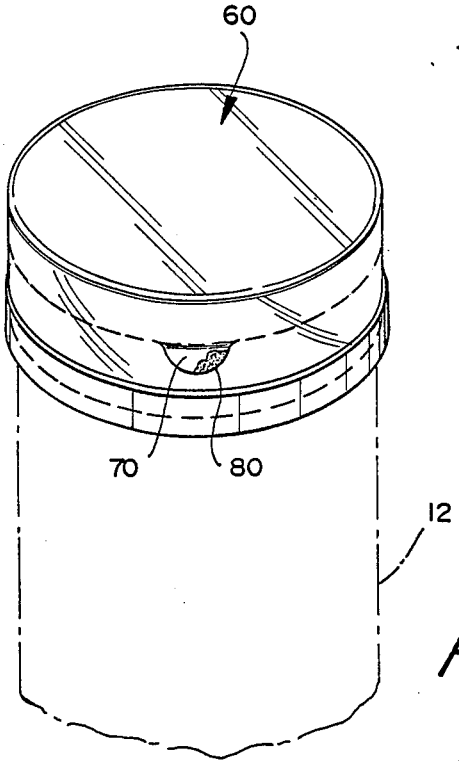
FIG. 9

SANITARY COVER FOR POP-TOP BEVERAGE CONTAINER

BACKGROUND OF THE INVENTION

This invention relates generally to closures for containers, and more particularly to a sanitary cover for containers for beverages such as pop-top cans and the like.

Pop-top aluminum cans are widely used as containers for beverages. Pop-top cans have a number of well known advantages, included among which are their light weight, low cost, and ability to be recycled. They also have one significant disadvantage for the consumer of beverages and similar products. The top of the can gets dirty. When the can is opened, a portion of the pop-top closure projects into the can, and this may introduce contaminants into the beverage. Moreover, the structure of a pop-top can is such that contaminants from the outside of the can around the top are actually washed into the contents as the beverage is being consumed. Cleaning the top of the can, as by wiping it, before opening the can is often inconvenient, especially when the can comes from a vending machine, and is generally ineffective. At present, there is no way of preventing the top of the can from becoming dirty, and the only way to prevent contamination of the contents is to clean the top thoroughly before the can is opened. This problem is not limited to pop-top aluminum cans, but is shared by other types of containers.

There exists a need for a cover for containers of consumable beverages or other food products and the like which avoids the foregoing problem by providing a clean sanitary area around the opening of the container to avoid contamination of the contents of the container. It is to these ends that the present invention is directed.

SUMMARY OF THE INVENTION

The invention satisfies the above-stated need in a rather simple, cost effective and convenient way by providing a form-fitting cover, preferably of elastic material, which is attached substantially permanently to the container and which is formed to cover an area surrounding the container opening. The cover prevents the area around the opening from becoming dirty or otherwise contaminated. Upon the cover being partially removed, a clean sanitary area around the opening is exposed without the inconvenience and difficulty of wiping or cleaning the area beforehand. The invention involves only negligible changes and increased costs in the manufacturing process of standard containers such as pop-top cans, and involves no change in vending machines, or the handling, stocking, etc. of such containers.

Broadly stated, in accordance with one aspect, the invention provides a sanitary cover for a container comprising a sheet or membrane which is formed to stretch over and cover the top of the container and to extend along the container sidewall. Means are provided for attaching the sheet to the sidewall at a predetermined distance from the top of the container. A tear seam or line of weakness is formed in the sheet, and a pull tab is attached to the sheet to enable the tear seam or line of weakness to be ruptured upon the pull tab being pulled and a clean area of the container which was previously covered by the sheet to be exposed. Preferably, the sheet is elastic and is attached to the container in a stretched condition so that when the sheet is ruptured it recedes by virtue of its elasticity from the top of the container and gathers around the sidewall.

In accordance with another aspect, the invention provides a container having a pop-top opening in a top of the container, and a form-fitting cover covering the top of the container and extending along the sidewall and being attached to the sidewall at a predetermined distance from the top. The cover has means which enables the cover to be ruptured to expose a clean area around the pop-top opening.

In accordance with more specific aspects, the rupturable sanitary cover membrane may comprise a thin sheet of latex rubber or other elastic or non-elastic material which is attached to the sidewall of the container by an adhesive or a band, e.g., tape, which extends around the container. The line of weakness in the membrane may comprise either a perforated seam, a line of reduced thickness, or a line which is bordered by a pair of parallel strips of non-elastic material adhered to the membrane so as to define therebetween a tear line. The line of weakness in the membrane may extend diametrically across the top of the container and downwardly along the sidewall on either side of the container to the point of attachment to the sidewall. Alternatively, the line of weakness may extend circumferentially about the sidewall approximately three-quarters, for example, of the way around the circumference at a predetermined distance below the top of the container. Upon the membrane rupturing, it thus tears three-quarters of the way around the circumference and recedes away from this area and from the top to gather at the one-fourth area of the circumference where the embrane is still attached to the sidewall.

BRIEF DESCRIPTION OF THE DRAWINGS

FIG. 1 is a perspective view of a rupturable sanitary cover in accordance with a first embodiment of the invention shown attached to a cylindrical container such as a pop-top can;

FIG. 2 is a partial perspective view showing the sanitary cover of FIG. 1 after being ruptured and gathered around the sidewall of the can to expose the pop-top opening mechanism in the top of the can;

FIG. 3 is a top view of another embodiment of a sanitary cover in accordance with the invention;

FIG. 4 is a cross-sectional view taken approximately along the line 4—4 of FIG. 3;

FIG. 5 is a top view similar to FIG. 4 of another embodiment of a sanitary cover in accordance with the invention;

FIG. 6 is a cross-sectional view similar to FIG. 4 taken approximately along the line 6—6 of FIG. 5;

FIG. 7 is a top view of yet another embodiment of a sanitary cover in accordance with the invention;

FIG. 8 is a perspective view of the sanitary cover of FIG. 7; and

FIG. 9 is a perspective view similar to FIG. 8 of a modification of the embodiment of the sanitary cover of FIGS. 7 and 8.

DESCRIPTION OF PREFERRED EMBODIMENTS

The present invention is especially adapted for use as a sanitary cover with pop-top beverage containers and the like and will be described in that environment. As will become apparent, however, this is illustrative of only one utility of the invention and the invention may be used with other types of containers.

Referring to the drawings, FIGS. 1 and 2 illustrate a first embodiment of a sanitary cover 10 in accordance with the invention which is shown applied to a container 12, such as a pop-top aluminum beverage can. FIGS. 3 and 4 illustrate a second embodiment of the sanitary cover 10 which is substantially the same as the first embodiment illustrated in FIGS. 1 and 2 except as will be described shortly.

As shown in FIGS. 1–4, the sanitary cover 10 may comprise a thin sheet or membrane 14 of elastic material, such as clear latex rubber or other plastic material, and the container may comprise a cylindrical container body formed of a top 16 and a sidewall 18. The membrane extends over the top 16 of container 12 so as to cover the top and extends axially along the sidewall 18 of the container for a predetermined distance from the top. The membrane, which also preferably extends circumferentially completely about the container, may be attached at its lower peripheral edge 20 to the container by a band 22, e.g., as of tape, or otherwise by means of an adhesive. The elastic membrane is preferably stretched to approximately the midpoint of its elasticity so that it is under tension, and attached to the sidewall all the way around the circumference of the container. On a conventional pop-top can, the distance below the top 16 of the can at which the membrane is attached to the sidewall may be of the order of one inch or so. As will be describe shortly, this is sufficient to afford a clean sanitary mouth area at the top of the can and on the sidewall below the top for drinking.

As best illustrated in FIG. 4, when membrane 14 is stretched over the top of container 12, it conforms closely to the top and sidewall of the cylindrical container and assumes substantially a cup shape having a circular top portion 24 which covers the top 16 of the container and a side portion 26 which extends along the sidewall of the container. Attaching the membrane to the container only in the area of its lower edge 20 enables the elastic membrane to conform easily to container and produce a close form-fitting cover. It also has the advantage of facilitating exposure of a clean area when the membrane is ruptured and enabling the membrane to gather up at an out-of-the-way location, as will be described. The region 30 of the membrane between the top 24 and side 26 of the membrane, corresponding to the location of the marginal top rim 32 of the container, may have an increased thickness as shown in FIG. 4 for reinforcement to prevent the membrane from being torn during shipment or storage of the container. The gauge or weight of the material used for membrane 14 may be selected in a well-known manner by those skilled in the art depending upon the particular type of material used, the desired strength, the type of container, etc.. The dimensions of membrane 14 and band 22 shown in FIG. 4, relative to the dimensions of container 12 have been selected for ease of illustration and are not necessarily to scale. This is also true of FIG. 6.

As shown in FIG. 1, the cover may be formed with a line of weakness or tear line 34 which extends diametrically across the top portion 24 of the cover and axially along opposite sides 26 of the cover. The line may terminate just before the rim 32 of the container and then continue downwardly along the sides. Line 34 may be designed to tear and separate under stress in order to rupture the membrane. Alternatively, the tear line may be a seam in the membrane which is formed to separate upon stress being applied. To accomplish rupturing, a pull tab 36 may be attached to the top 24 of the membrane adjacent to line 34 as shown. The pull tab may be reinforced with a triangular-shaped reinforcement 38 which provides rigidity to the pull tab. One corner 40 of the triangular reinforcement may be located at the line 34, as shown. Upon the pull tab being pulled, the membrane will begin to separate at this point as the tab exerts stress on the seam. The elastic tension in the membrane will cause it to tear and to recede quickly onto the sides of the container. The ruptured membrane will roll-up or gather about the sides of the container at the location of band 22, as shown in FIG. 2. FIG. 2 also shows a break 42 in the gathered membrane corresponding to the location of the ruptured tear seam 34. The elastic membrane will be fully contracted, as shown, to expose a clean, sanitary mouth area for drinking at the top 16 and sidewall 18 of the container. A pop-top opening mechanism 44 located in the top 16 of the container may be operated in the usual manner without interference from the membrane to open the container. Since the top was covered by the membrane, contaminants will not be introduced into the container by the pop-top mechanism. Advantageously, the entire membrane, including the pull tab, will remain attached to the container so that it will be disposed of appropriately along with the container.

The embodiment of the cover illustrated in FIGS. 3 and 4 may be substantially the same as that shown in FIGS. 1 and 2, as explained previously, except for the construction of the tear line or seam 34. In the embodiment of FIG. 1, line 34 may be formed as a line of perforations in the membrane. In the embodiment of FIGS. 3 and 4, the tear line may be a line of reduced thickness 48, as best illustrated in FIG. 4. FIG. 4 also illustrates the attachment of pull tab 36 to the membrane adjacent to the line. The pull tab may be formed integrally with the membrane, as by molding, or separately and later attached to the membrane.

FIGS. 5 and 6 illustrate another embodiment of a sanitary cover in accordance with the invention. In the embodiment of FIGS. 5 and 6, a line of weakness or tear seam 50 may be formed by a pair of parallel non-elastic strips 52 and 54, as of plastic, which are adhered to membrane 14 in spaced apart relationship as illustrated in FIG. 5. A pull tab 56 may be attached to one of the strips, e.g., strip 52, as shown, and may be formed of the same material as the strips. Upon the pull tab being pulled, the membrane will begin to rupture or separate in the small area between the two strips at the location of the pull tab, and the tear will progress diametrically across the top of the membrane and axially along the sides, thereby allowing the membrane to recede in the manner previously described and illustrated in FIG. 2.

FIGS. 7 and 8 illustrate another embodiment of a sanitary cover 10 in accordance with the invention. The previously described embodiments are best suited for a membrane which has high elasticity, whereby the elastic energy in the membrane causes it to recede and gather around the sidewall as described. The embodiment illustrated in FIGS. 7 and 8 is similar to the embodiments previously described, but it is more suitable for a membrane of a lesser degree of elasticity. As shown, the cover 10 may comprise a membrane 60 having a top 64 which covers the top of container 12 and a side 66 which extends axially along the sidewall of the container and which may be attached thereto by a band 22, as before. It differs from the previous embodiments, however, in that rather than having a diametrically extending line of weakness across the top of the membrane, a line of weakness 68 is formed so as to extend circumferentially about side 66 of the membrane a predetermined distance below the top 64 of the membrane, as shown in FIG. 8. Line of weakness 68 may be formed as previously described as a line of perforations such as 34 of FIG. 1, as a tear line or seam of reduced thickness such as 48 of FIGS. 3 and 4, or by means of a pair of non-elastic strips such as 52 and 54 of FIGS. 5 and 6. As shown in FIG. 8, pull tab 70 may be located on the side 66 of the membrane adjacent to line of weakness 68. Preferably, as indicated in FIG. 7, the line of weakness does not extend all the way around the circumference of the container. Rather, the line of weakness may extend only about three-fourths around the circumference and a portion 72, such as the remaining one-fourth of the circumference located diametrically on the opposite side of the container from pull tab 70, may be unweakened (as indicated by the solid line in FIG. 7). Thus, when pull tab 70 is pulled to rupture the membrane along the line of weakness, the membrane may be removed manually or it will recede under its own elasticity from over the top of the container as before to expose a clean sanitary area comprising the top and the preselected distance of the container sidewall below the top which was previously covered by the membrane. The membrane flap will gather at the opposite side of the container from the pull tab and remain connected at 72 to the lower portion 74 of the membrane which is attached to the container as by tape or band 22. The line of weakness need not be parallel to the top rim of the container, but may dip downwardly at the pull tab to form a mouth area.

With the embodiment of FIGS. 7 and 8, when the membrane is used on a pop-top can, it will be necessary to orient the membrane relative to the pop-top opening so that pull tab 70 is located at approximately the front (drinking area) of the can and attachment portion 72 is on the other side (rear) of the can. In this embodiment, the membrane flap may not be as out of the way after being opened as in the previous embodiments, but is still sufficiently receded to enable the pop-top mechanism to be operated in the usual manner and to be out of the way for drinking from the container. Membrane 60 may be made of a heavier gauge material than that employed for the embodiments of FIGS. 1–6, and the reinforcement area 30 around the top of the membrane adjacent to the rim of the container employed for the previous embodiments may be eliminated. In addition, the membrane 60 may have a lesser degree of elasticity then that employed for the previous embodiments. In fact, the membrane may have little elasticity, if desired, in which case it may be necessary to remove the membrane manually to expose the clean area.

FIG. 9 shows a variation of the embodiment of FIGS. 7 and 8 in which pull tab 70 may be provided with a moisture-proof adhesive 80 on its underside to hold the tab stuck to the lower portion 74 of the membrane. When the membrane is ruptured or otherwise removed to expose the top portion of the container, the sticky adhesive on the back of the tab enables the membrane flap to be secured (stuck) to the rear side of the container adjacent to region 72 so as to hold the membrane flap out of the way. This variation permits the membrane to be of a material having little or no elasticity. One of the advantages of using a membrane having elasticity is that this provides the power to cause the membrane to recede away from the exposed area around the opening of the container when the membrane is ruptured and is convenient for holding the ruptured membrane away from this area. It may be advantageous and desirable in some cases, however, to use a material having a lesser degree of elasticity, as, for example, a heat-shrink type of plastic material. With membrane 60 of FIGS. 7 and 8, the ruptured membrane flap may be tucked back out of the way at the rear of the container adjacent to area 72. By employing a sticky adhesive 80 on the pull tab, the ruptured membrane flap can be held conveniently out of the way by sticking the pull tab to the rear of the container without the necessity of relying upon the elasticity of the membrane to hold the ruptured portion clear of the exposed area. The embodiments of FIGS. 7–9 are well suited both for materials of little or no elasticity, as well as materials of high elasticity.

From the foregoing, it will be appreciated that the invention affords a highly advantageous sanitary cover which has utility on many different types of containers, both metal as well as plastic or paper, for beverages and other consumable food products and the like. The invention is particularly advantageous for use on pop-top cans for keeping the top drinking area free of dirt and other contaminants. This is particularly important for cans dispensed from vending machines and the like where the opportunity for cleaning the top of the can before opening it may be limited. It is significant that the membrane which covers the top of the can is secured substantially permanently to the container and remains with the container after being ruptured to expose a clean area around the opening. This avoids litter in that the membrane by remaining attached to the container is discarded along with the container.

While preferred embodiments of the invention have been shown and described, it will be appreciated by those skilled in the art that changes may be made in these embodiments without departing from the principles and spirit of the invention, the scope of which is defined in the appended claims.

We claim:

1. A sanitary cover for a container of the type having a sidewall portion and a top portion connected to the sidewall portion, the top portion including an opening member for the container, the cover comprising a membrane formed to stretch over the top portion and to extend along the sidewall; means for attaching the membrane to the sidewall at a predetermined distance from the top portion; a tear line formed in the membrane; and a manually operable pull tab attached to the membrane to enable the tear line to be ruptured upon the tab being pulled and a clean area of the container around the opening member to be exposed.

2. The cover of claim 1, wherein the membrane comprises a sheet of elastic material which is attached to the container in a stretched condition.

3. The cover of claim 1, wherein the tear line extends diametrically across the top portion and axially along the sidewall on opposite sides of the container such that upon being ruptured the membrane splits into two parts and gathers around the sidewall at the predetermined distance from the top.

4. The cover of claim 1, wherein the tear line is located in the membrane adjacent to the sidewall and extends partially about the circumference of the container.

5. The cover of claim 4, wherein the tear line extends approximately three-quarters of the way around the circumference, and the membrane is unweakened in approximately one-fourth of the circumference so as to remain attached to the container upon being ruptured.

6. The cover of claim 5, wherein the pull tab is attached to a part of the membrane which is moved to expose the top portion of the container upon the membrane being ruptured.

7. The cover of claim 6, wherein the pull tab has an adhesive applied thereto to enable the membrane to be stuck to the container to hold said part of the membrane away from the exposed top portion.

8. The cover of claim 1, wherein the tear line comprises a line of perforations in the membrane.

9. The cover of claim 1, wherein the tear line comprises a line of reduced thickness in the membrane.

10. The cover of claim 1, wherein the tear line comprises an area formed between a pair of parallel spaced non-elastic strips which are applied to the membrane.

11. The cover of claim 1, wherein the attaching means comprises a band for securing a lower peripheral edge of the membrane to the container.

12. The cover of claim 1, wherein the membrane comprises a sheet of latex rubber, the sheet having an area of increased thickness adjacent to a top rim of the container for reinforcement of the membrane.

13. The cover of claim 12, wherein the tear line extends diametrically across a part of the membrane covering the top portion of the container and terminates in such part before the reinforced area at the rim.

14. The cover of claim 13, wherein the pull tab is connected to the membrane so as to extend along the tear line, and has a reinforced portion with a corner located at the tear line.

15. The cover of claim 1, wherein the cover comprises an elastic membrane stretched to approximately its midpoint of elasticity such that upon being ruptured the membrane recedes from and exposes the top portion and a portion of the sidewall of the container and gathers about the container adjacent to the predetermined distance from the top at which the membrane is attached to the container.

16. A pop-top container comprising a container body having a top with a pop-top opening mechanism therein and a sidewall; a form-fitting sanitary cover covering the top and extending axially along the sidewall for a predetermined distance from the top; means for attaching the cover to the sidewall; and means for rupturing the cover to expose an area about the pop-top opening mechanism.

17. The container of claim 16, wherein the cover comprises an elastic membrane, and the rupturing means comprises a tear line formed in the membrane and a pull tab attached to the membrane adjacent to the tear line.

18. The container of claim 17, wherein the attaching means comprises means for attaching the membrane to the sidewall at said predetermined distance from the top, and wherein the membrane is formed to remain attached to the container upon being ruptured.

19. The container of claim 17, wherein the tear line comprises an area of the membrane between a pair of parallel spaced non-elastic strips which are attached to the membrane, the pull tab being attached to one of said strips.

20. The container of claim 17, wherein the tear line comprises a line of weakness formed in the membrane so as to extend diametrically across the top of the container and axially along the sidewall on opposite sides of the container, the pull tab being attached to the membrane adjacent to the line of weakness at the top of the container, and the pull tab having a reinforcement at the line of weakness so as to rupture the membrane upon the pull tab being pulled.

* * * * *

UNITED STATES PATENT AND TRADEMARK OFFICE

CERTIFICATE OF CORRECTION

PATENT NO. : 4,895,270

DATED : January 23, 1990

INVENTOR(S) : Daniel M. Main and James S. Ficklin

It is certified that error appears in the above-identified patent and that said Letters Patent is hereby corrected as shown below:

On cover page - In the Abstract, line 11, change "drainking" to -- drinking --.

Signed and Sealed this

Ninth Day of April, 1991

*Attest:*

HARRY F. MANBECK, JR.

*Attesting Officer*

*Commissioner of Patents and Trademarks*